US006191670B1

(12) United States Patent
Nguyen

(10) Patent No.: US 6,191,670 B1
(45) Date of Patent: Feb. 20, 2001

(54) LOW-LOSS DUPLEXER WITHOUT SETTINGS

(76) Inventor: Alain Nguyen, 97/125 avenue Roger Salengro, Chatenay Malabry 92290 (FR)

( * ) Notice: Under 35 U.S.C. 154(b), the term of this patent shall be extended for 0 days.

(21) Appl. No.: 09/313,589

(22) Filed: May 18, 1999

(30) Foreign Application Priority Data

May 18, 1998 (EP) ..... 98460013

(51) Int. Cl.[7] ..... H01P 1/20; H01P 5/12
(52) U.S. Cl. ..... 333/208; 333/126; 333/135
(58) Field of Search ..... 333/126, 208, 333/135

(56) References Cited

U.S. PATENT DOCUMENTS

| | | | | |
|---|---|---|---|---|
| 4,890,078 | | 12/1989 | Radcliffe . | |
| 5,023,624 | * | 6/1991 | Heckaman et al. | 333/247 |
| 6,031,710 | * | 2/2000 | Wolf et al. | 333/185 |

FOREIGN PATENT DOCUMENTS

| | | | |
|---|---|---|---|
| 2 346 868 | 10/1977 | (FR) | H01P/1/20 |
| 2346868 | 10/1977 | (FR) | H01P/1/20 |
| 63308401 | 12/1988 | (JP) | H01P/1/213 |

OTHER PUBLICATIONS

"Linear Phase Microwave Bandpass Filters", by G. Pfitzenmaier, Proceedings of the European Microwave Conference, Brussel, 4–7, Sep., 1973, vol. 2 Conf. 3, Sep. 4, 1973, p. B.2.01 XP–002073863.

* cited by examiner

*Primary Examiner*—Robert Pascal
*Assistant Examiner*—Patricia T. Nguyen

(57) ABSTRACT

A duplexer for microwave signals that requires no system of settings by screws. The duplexer includes two tunnels, each having a longitudinal passage and compartments demarcated by transversal partition walls. The compartments, the longitudinal passages and the common part are hollowed out in the plane upper surface of a monolithic block. The tunnels are closed on the top by a lid that adheres uniformly to the plane surface.

14 Claims, 3 Drawing Sheets

LOW-LOSS DUPLEXER WITHOUT SETTINGS

CROSS-REFERENCE TO RELATED APPLICATION

This application claims priority of European Patent Application No. 98460013.0, which was filed on May 18, 1998.

FIELD OF THE INVENTION

The present invention relates generally to the field of duplexers, and more particularly to duplexers for microwave signals.

BACKGROUND OF THE INVENTION

Duplexers are usually devices found at the end of a system in items of radio equipment, i.e. antennas. They are designed to separate the signals transmitted from the signals received by the antenna. A duplexer conventionally includes two passband filters, one responsible for filtering the transmitted signals and the other responsible for filtering the received signals.

Conventionally, a passband filter for microwave signals includes a tunnel having a succession of compartments communicating with one another through a longitudinal passage, the dimensions and number of compartments being a function of the size and the center frequency of the passband of the filter. A duplexer for microwave signals therefore generally has two tunnels of this type that are respectively connected by one end to the transmission part and to the reception part of the radio equipment and that open jointly into the other end on the antenna side.

These passband filters are designed to meet the following conditions:

high resistance under temperature throughout the range;

low loss in transmission and high return loss in the passband; and high rejection in the near band.

With respect to the rejection of the highest frequencies, especially for the elimination of the harmonics of the filtered signal, the equipment is generally provided with a low pass filter interposed between the duplexer and the antenna.

To meet the first condition, existing duplexers are generally made of a material that is highly stable under temperature, for example invar which is an alloy of iron and nickel with a coefficient of thermal expansion that is practically zero. However, this type of material proves to be very costly and very difficult to machine. Thus, the method generally used to manufacture duplexers is to make tunnels out of invar plates and solder transversal partition walls thereto so as to obtain compartments in these tunnels.

These duplexers are then methodically provided with a system of settings by screws to obtain the desired signal filtering and transmission characteristics. Tapped holes are made in the upper wall of the tunnels to receive setting screws. In general, one setting screw is provided per compartment with another screw being provided in the partition walls of each compartment in the longitudinal passage. The setting operation then includes adjusting the part of the screw that projects into the compartment or into the longitudinal passage. This operation proves to be very complicated and very lengthy.

Consequently, the present invention seeks to overcome the prior art drawbacks by proposing a duplexer that does not require a system of settings by screws for the usual frequencies.

SUMMARY OF THE INVENTION

The present invention solves the above problems by providing a duplexer for microwave signals having two passband filters designed to process incoming signals and outgoing signals, respectively, and to process these signals simultaneously. The filters include two tunnels that open jointly at one end by a common part into a first hole and open independently at the other end into a second hole and a third hole. Each of these tunnels has a longitudinal passage and compartments demarcated by transversal partition walls. The compartments, longitudinal passages and common parts are hollowed out in the upper plane face of a monolithic block. The tunnels are closed at the top from the first hole up to the second and third holes by a lid that adheres uniformly to the plane surface. The functional characteristics of the two filters are determined by dimensional parameters within the tunnels. These parameters include the thickness of each wall, the longitudinal and transversal dimensions of each compartment and the width of each longitudinal passage. In order that the compartments, the longitudinal passages and the common part of the duplexer may be hollowed out with precision in the monolithic block, the block and the lid are preferably made of aluminum. Aluminum is indeed easier to machine than invar. Since this material is less stable under temperature than invar, it is enough to provide for a slightly wider passband to compensate for the drifts in temperature of the material and increase the slope on the flanks of the passband of the filters to obtain the desired near band rejection. The joining surface of the lid is covered with a uniform layer of a brazing alloy to obtain uniform adhesion on all the surfaces in contact with the monolithic block and with the lid after soldering. The surfaces within the tunnels of the monolithic block are preferably subjected to a surface treatment to ensure efficient transmission of the signals in the tunnels. For example, the surface treatment may include adding a surface layer of silver. In a preferred embodiment, the common part through which the tunnels open into the first hole has a Y-shape and the external sides of its arms are concave.

BRIEF DESCRIPTION OF THE DRAWINGS

Other features and advantages of the invention shall appear from the following detailed description made with reference to the appended drawings, of which.

DETAILED DESCRIPTION

Figure 1:
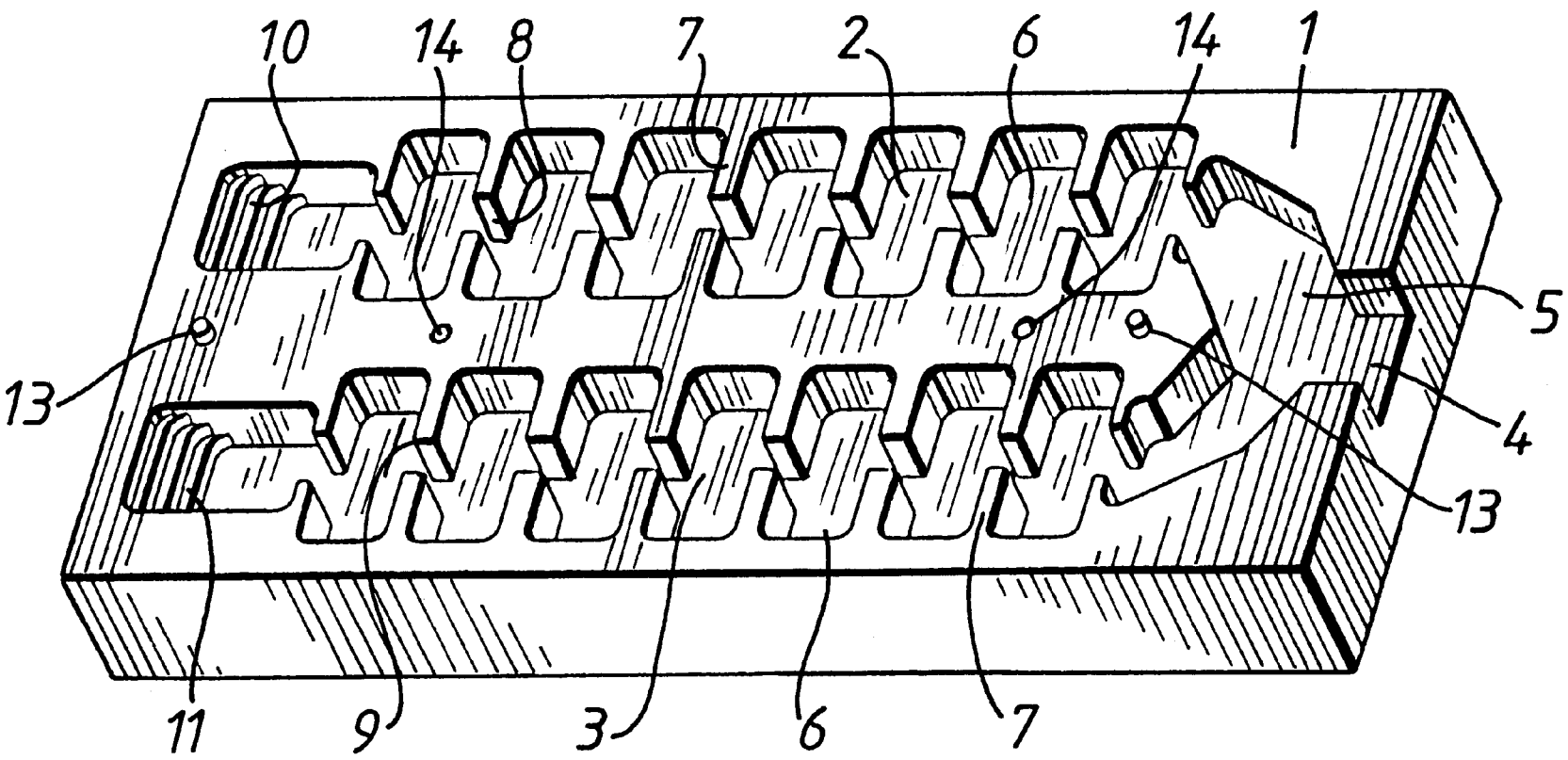
FIG. 1 shows a view in perspective of a monolithic block of a duplexer according to the invention.
Figure 2:
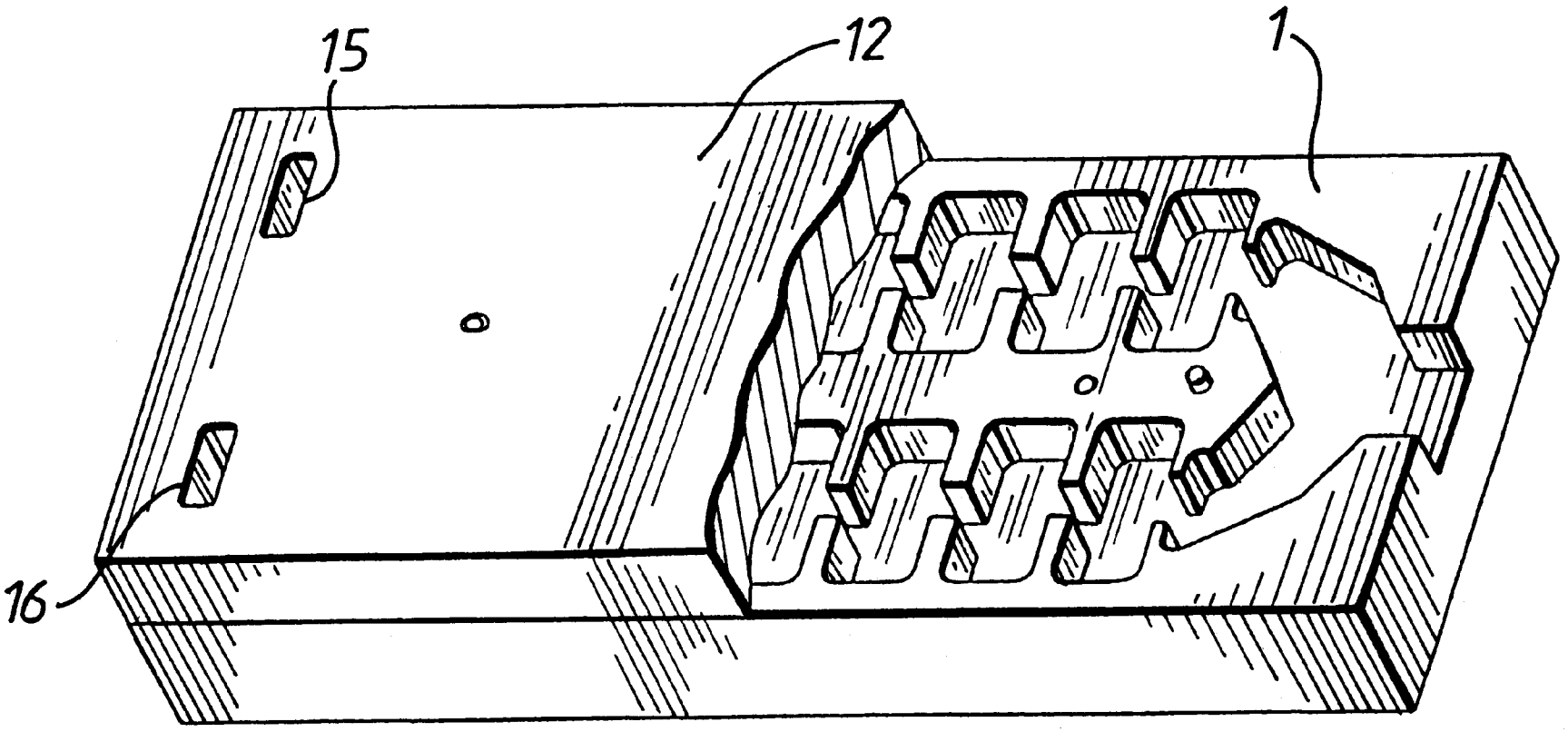
FIG. 2 shows a view in perspective of the monolithic block of FIG. 1 partially covered by a lid.

FIGS. 1 and 2 provide a particular illustration of a duplexer covering the 12.875 GHz–13 GHz frequency band for transmission and the 13.125 GHz–13.25 GHz frequency band for reception. Naturally, this type of duplexer may be used for other frequency bands in the microwave domain. It would then be enough to modify the characteristics of the compartments and of the longitudinal passage of the tunnels as well as the number of compartments to use the duplexer for other frequency bands.

According to the invention, each duplexer includes a monolithic block in which two tunnels are hollowed out with a common block joining these two tunnels and a lid to close the block on the top.

For reasons of clarity, the duplexer of FIG. 1 is shown without its lid. Consequently, only one monolithic block 1 is shown in FIG. 1. This block is a parallelepiped having six plane rectangular faces. The material used to manufacture the block is an aluminum-based alloy. This material is for example the alloy whose AFNOR designation is 2618A. This alloy is especially easy to machine and has a relatively low thermal expansion coefficient.

Two parallel tunnels 2 and 3 are hollowed out into the plane upper surface of the monolithic block. These two tunnels open jointly at a first end into a hole 4 by means of a common Y-shaped part 5. The hole 4 is located on the antenna side.

The tunnels 2 and 3 include a succession of compartments 6 demarcated by transversal partition walls 7 which are in sets of two that face each other on either side of a longitudinal passage. This longitudinal passage is referenced 8 for the tunnel 2 and 9 for the tunnel 3. The dimensional parameters within the tunnels 2 and 3 determine the functional characteristics of the two filters of the duplexer, namely, the transmission losses and the return loss of the filters in the passband and their rejection in near band. The thickness of the partition walls 7, the longitudinal and transversal dimensions of the compartments 6 and the width of the longitudinal passages 8 and 9 fix these characteristics with precision. The prior art system of setting by means of screws is then superfluous, at least in the range of usual frequencies.

For the compartments 6, the longitudinal passages 8 and 9 and the common part 5 can be made by the milling technique which provides a totally satisfactory degree of precision (of about +/− 15 microns) for the applications in view. A mill with a radius of 2 millimeters is then enough to obtain the desired precision. In the example of FIGS. 1 and 2, the longitudinal dimension of the compartments and the width of the longitudinal passages are defined with a precision of +/− 15 microns. The other dimensions are defined with a smaller precision of the order of +/−20 microns.

The internal walls of the tunnels 2 and 3 are advantageously provided with surface treatment to ensure the efficient transmission of the signals. For example, this treatment includes the addition of a surface layer of silver. This layer will also be used to protect the block from possible oxidation. It is preferably extended through the block.

As shown in FIGS. 1 and 2, the common part 5 has a Y-shape. For reasons of gain in space in particular, the external sides of the arms of the Y have concavities. The concavities shown in FIGS. 1 and 2 are dihedrons. As a variant, it is possible to provide for a common T-shaped part. According to another embodiment, it is also possible to make the tunnels 2 and 3 converge on the common hole 4 by positioning them in the form of a V.

In the embodiment shown in FIGS. 1 and 2, the monolithic block 1 has orthogonal elbows with steps 10 and 11, upline with respect to the tunnels 2 and 3. The orthogonal elbows used to obtain a 90° change in direction.

FIG. 2 shows a view in perspective of the monolithic block of FIG. 1. This block is closed on top by a flat lid 12, which is shown partially. This aluminum lid is designed to adhere uniformly to the entire plane upper surface of the monolithic block 1. The joining of the block 1 and of the lid 12 is done by brazing. To do so, the joining surface of the lid 12 is covered with a uniform layer of a brazing alloy on a thickness of 20 micrometers. This brazing alloy is preferably formed by 60% tin and 40% lead. The adhesion between the surfaces in contact of the block 1 and the lid 12 is obtained by soldering by heating the entire unit. The layer of alloy covering the lid is used both as a filler metal for the brazing and as a protection layer for the lid. Advantageously, the monolithic block 1 has prepositioning pins 13 as well as tapped holes 14 so as to facilitate the positioning of the lid 12 with respect to the block 1 and to place this lid and block flat against each other by means of screws.

Furthermore, windows 15 and 16 are hollowed out through the lid 12 to form the exit at 90° from the elbows 10 and 11.

Figure 3:
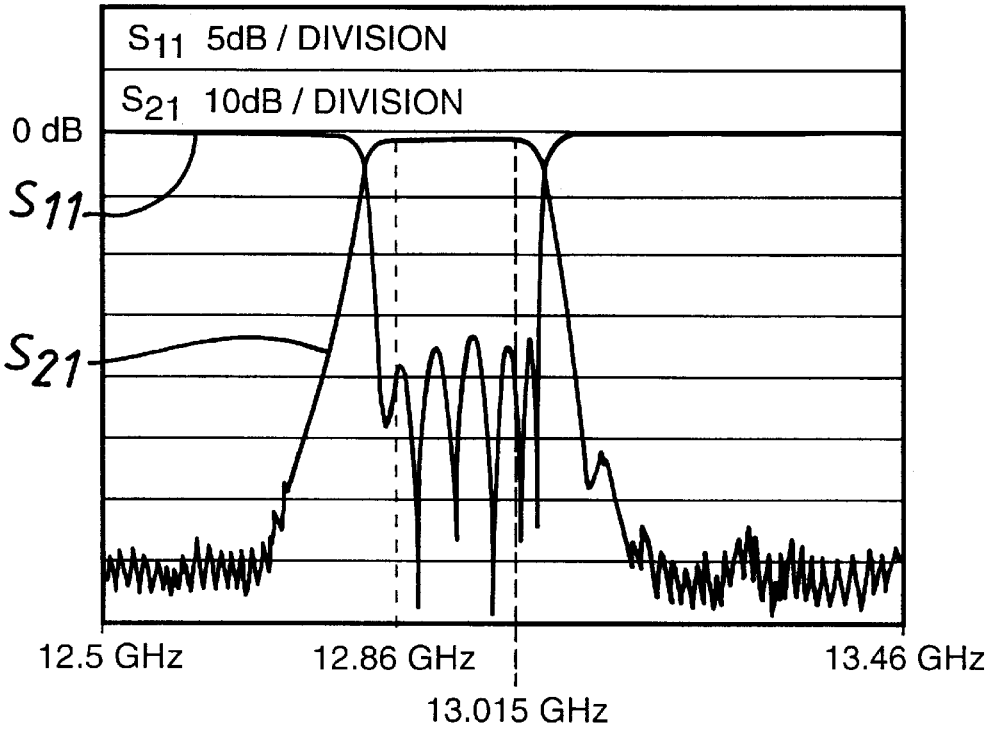
FIGS. 3 and 4 are curves of results of the duplexer of FIGS. 1 and 2.
Figure 4:
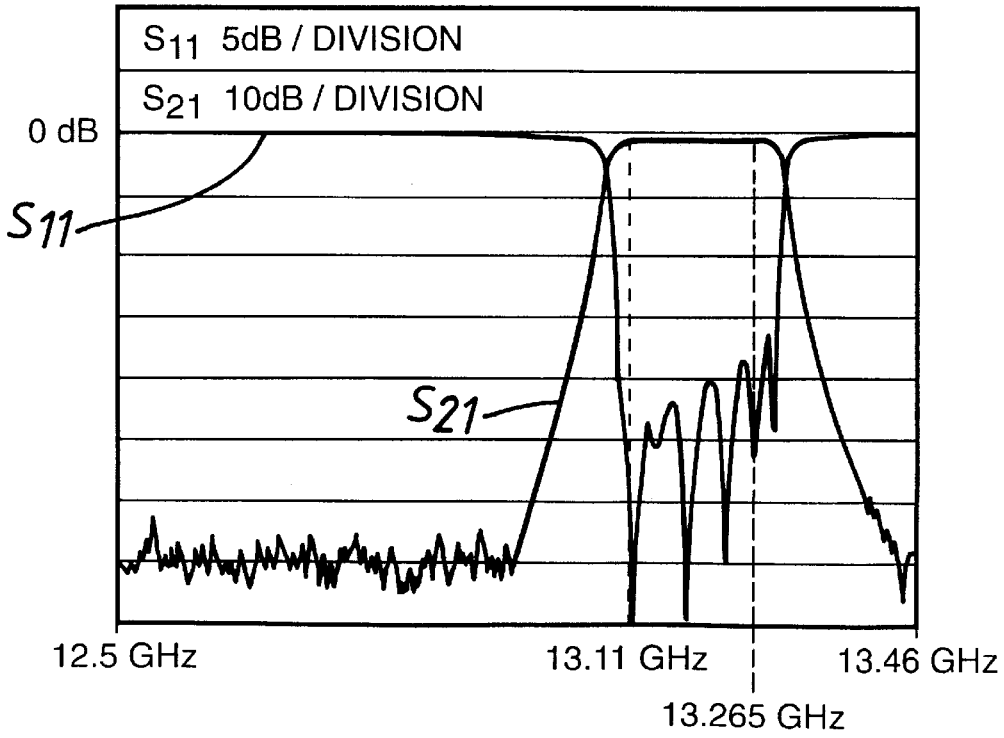

FIGS. 3 and 4 show the results obtained in tests on a prototype corresponding to a duplexer as shown in FIGS. 1 and 2, namely a duplexer covering the 12.875 GHz–13 GHz band of frequencies in transmission and the 13.125 GHz–13.25 GHz band of frequencies in reception. The parameters S21 and S11, illustrated in FIGS. 3 and 4 respectively, show the transmission losses and return losses of the duplexer of the invention. FIG. 3 shows the value of the parameters S21 and S11 on the transmission band of the duplexer and FIG. 4 shows the value of these parameters on the reception band.

Since the frequency drift of the passband of the filters of the duplexer throughout the range of temperatures does not exceed 15 MHz around the frequency response to a temperature of 25° C., the passband of the filters of the duplexer have been widened by 30 MHz to cope with this drift. That is, the frequency band covered by the duplexer at a temperature of 25° C. is taken to be equal to 12.860 GHz–13.015 GHz for transmission and 13.110 GHz–13.265 GHz for reception.

The measurement curves show that:

a) the transmission losses (parameter S21) are always below 1 decibel;

b) the return loss (parameter S11) is always greater than 17 decibels;

c) by superimposing the curves, it is seen that the near band rejection is greater than 56 decibels.

According to an alternative embodiment, it is possible to consider covering the frequency band 12.875 GHz–13 GHz (transmission) and 13.125 GHz–13.25 GHz (reception) by using two duplexers and thus having, for each duplexer, a transmission band and a reception band that is half as wide. This would make it possible to reduce the constraints when designing the duplexer. In particular, the rejection of the near band would not have to be as great. However, this would have the drawback of doubling the number of pieces of equipment.

Given what has been described here above, the duplexer of the invention has the following advantages:

simplicity of manufacture leading to low cost price;

the elimination of lengthy and costly setting times;

a high degree of reproducibility to enable mass production on an industrial scale; and excellent electrical performance characteristics.

What is claimed is:

1. A duplexer for microwave signals comprising:

two passband filters for processing incoming signals and outgoing signals, respectively, and to process these signals simultaneously, the filters having:

a monolithic block;

two tunnels that open jointly at one end by a common part into a first hole and open independently at the other end into a second hole and third hole, each tunnel including a longitudinal passage, and compartments demarcated by transversal partition walls, the compartments, the longitudinal passages and the common parts are hollowed out in the upper plane face of the monolithic block, each tunnel being without a cavity for a screw that is enabled to set the frequency of the filter; and a lid that adheres uniformly to the upper plane surface, the lid for the tunnels being closed at the top from the first hole up to the second and third holes;

the functional characteristics of the two filters being determined by dimensional parameters within the tunnels.

2. The duplexer for microwave signals according to claim 1, wherein:

the monolithic block and the lid are made of aluminum; and a joining surface of the lid is covered with a uniform layer of a brazing alloy to obtain uniform adhesion on all the surfaces in contact with the monolithic block and with the lid after soldering.

3. A duplexer for microwave signals comprising:

two passband filters for processing incoming signals and outgoing signals, respectively, and to process these signals simultaneously, the filters having:

a monolithic block;

two tunnels that open jointly at one end by a common part into a first hole and open independently at the other end into a second hole and third hole, each tunnel including a longitudinal passage, and compartments demarcated by transversal partition walls, the compartments, the longitudinal passages and the common parts are hollowed out in the upper plane face of the monolithic block; and a lid that adheres uniformly to the upper plane surface, the lid for the tunnels being closed at the top from the first hole up to the second and third holes;

the functional characteristics of the two filters being determined by dimensional parameters within the tunnels;

the monolithic block and the lid are made of an aluminum alloy;

a joining surface of the lid is covered with a uniform layer of a brazing alloy to obtain uniform adhesion on all the surfaces in contact with the monolithic block and with the lid after soldering; and the brazing alloy comprises 60% of tin and 40% of lead.

4. A duplexer for microwave signals comprising:

two passband filters for processing incoming signals and outgoing signals, respectively, and to process these signals simultaneously, the filters having:

a monolithic block;

two tunnels that open jointly at one end by a common part into a first hole and open independently at the other end into a second hole and third hole, each tunnel including a longitudinal passage, and compartments demarcated by transversal partition walls, the compartments, the longitudinal passages and the common parts are hollowed out in the upper plane face of the monolithic block; and a lid that adheres uniformly to the upper plane surface, the lid for the tunnels being closed at the top from the first hole up to the second and third holes;

the functional characteristics of the two filters being determined by dimensional parameters within the tunnels;

the monolithic block and the lid are made of an aluminum alloy;

a joining surface of the lid is covered with a uniform layer of a brazing alloy to obtain uniform adhesion on all the surfaces in contact with the monolithic block and with the lid after soldering; and at least a surface inside the tunnels of the monolithic block are subjected to surface treatment to ensure the efficient transmission of the signals in the tunnels.

5. The duplexer for microwave signals according to claim 4, wherein the surface treatment includes the addition of a surface layer of silver.

6. The duplexer for microwave signals according to claim 1, wherein the common part by which the tunnels open into the first hole has a Y shape.

7. The duplexer for microwave signals according to claim 6, wherein the external sides of the arms of the Y-shaped common part are concave.

8. The duplexer for microwave signals according to claim 7, wherein the concavities of the outer edges of the arms of the common part are dihedrons.

9. The duplexer for microwave signals according to claim 1, wherein the parameters include the thickness of each wall, the longitudinal and transversal dimensions of each compartment and the width of each longitudinal passage.

10. The duplexer for microwave signals according to claim 1, wherein:

the monolithic block and the lid are made of an aluminum alloy; and a joining surface of the lid is covered with a uniform layer of a brazing alloy to obtain uniform adhesion on all the surfaces in contact with the monolithic block and with the lid after soldering.

11. The duplexer for microwave signals according to claim 4, wherein the common part by which the tunnels open into the first hole has a Y shape.

12. The duplexer for microwave signals according to claim 10, wherein the external sides of the arms of the Y-shaped common part are concave.

13. The duplexer for microwave signals according to claim 11, wherein the concavities of the outer edges of the arms of the common part are dihedrons.

14. The duplexer for microwave signals according to claim 4, wherein the parameters include the thickness of each wall, the longitudinal and transversal dimensions of each compartment and the width of each longitudinal passage.

* * * * *